US012274953B2

(12) United States Patent
Anderson

(10) Patent No.: US 12,274,953 B2
(45) Date of Patent: Apr. 15, 2025

(54) SNOWMAN FORMING DEVICE AND METHOD OF USE

(71) Applicant: Audrey Anderson, Memphis, TN (US)

(72) Inventor: Audrey Anderson, Memphis, TN (US)

( * ) Notice: Subject to any disclaimer, the term of this patent is extended or adjusted under 35 U.S.C. 154(b) by 37 days.

(21) Appl. No.: 17/860,440

(22) Filed: Jul. 8, 2022

(65) Prior Publication Data

US 2024/0009586 A1 Jan. 11, 2024

(51) Int. Cl.
*A63H 33/00* (2006.01)

(52) U.S. Cl.
CPC ..... *A63H 33/001* (2013.01)

(58) Field of Classification Search
CPC ... A63H 33/001; A62H 33/32; F25C 2400/06; F25C 3/00; F25C 1/24; F25C 1/04; F25C 1/246
See application file for complete search history.

(56) References Cited

U.S. PATENT DOCUMENTS

| | | | | |
|---|---|---|---|---|
| D375,964 | S | 11/1996 | Poubouridis | |
| 5,632,926 | A | 5/1997 | Dyer, Jr. | |
| 6,176,464 | B1 | 1/2001 | Harvey | |
| D535,348 | S | 1/2007 | Sammann | |
| 7,963,500 | B1 | 6/2011 | Holiday | |
| 10,245,522 | B1 | 4/2019 | Williams | |
| 2016/0114254 | A1 | 4/2016 | Diaz | |
| 2017/0050118 | A1* | 2/2017 | LaDuke | A63H 33/32 |
| 2018/0304167 | A1* | 10/2018 | Jones | F25C 3/00 |

FOREIGN PATENT DOCUMENTS

| | | | |
|---|---|---|---|
| CN | 211363650 U | * | 8/2020 |
| WO | WO2019209398 | | 10/2019 |

* cited by examiner

*Primary Examiner* — John J DeRusso
*Assistant Examiner* — Victoria Bartlett

(57) ABSTRACT

A snowman forming device for facile creation of a snowman includes first mold and second molds, which in turn comprise pairs of first and second shells, respectively. The first mold is substantially spherical. The first shells are hingedly engaged and selectively mutually engageable. The second mold comprises upper and lower lobes, which are substantially spherical. The second shells are selectively mutually engageable. First and second cutouts are positioned in upper and lower ends of the second mold, respectively. The first and second molds can be filled and packed with snow. The second cutout is positioned on a surface, and then the first mold is positioned upon the first cutout to form a snowman within the first and second molds. The first and second shells then are disengaged to reveal the snowman.

8 Claims, 8 Drawing Sheets

(ISO Top View)

(ISO Top View)

(Front View)

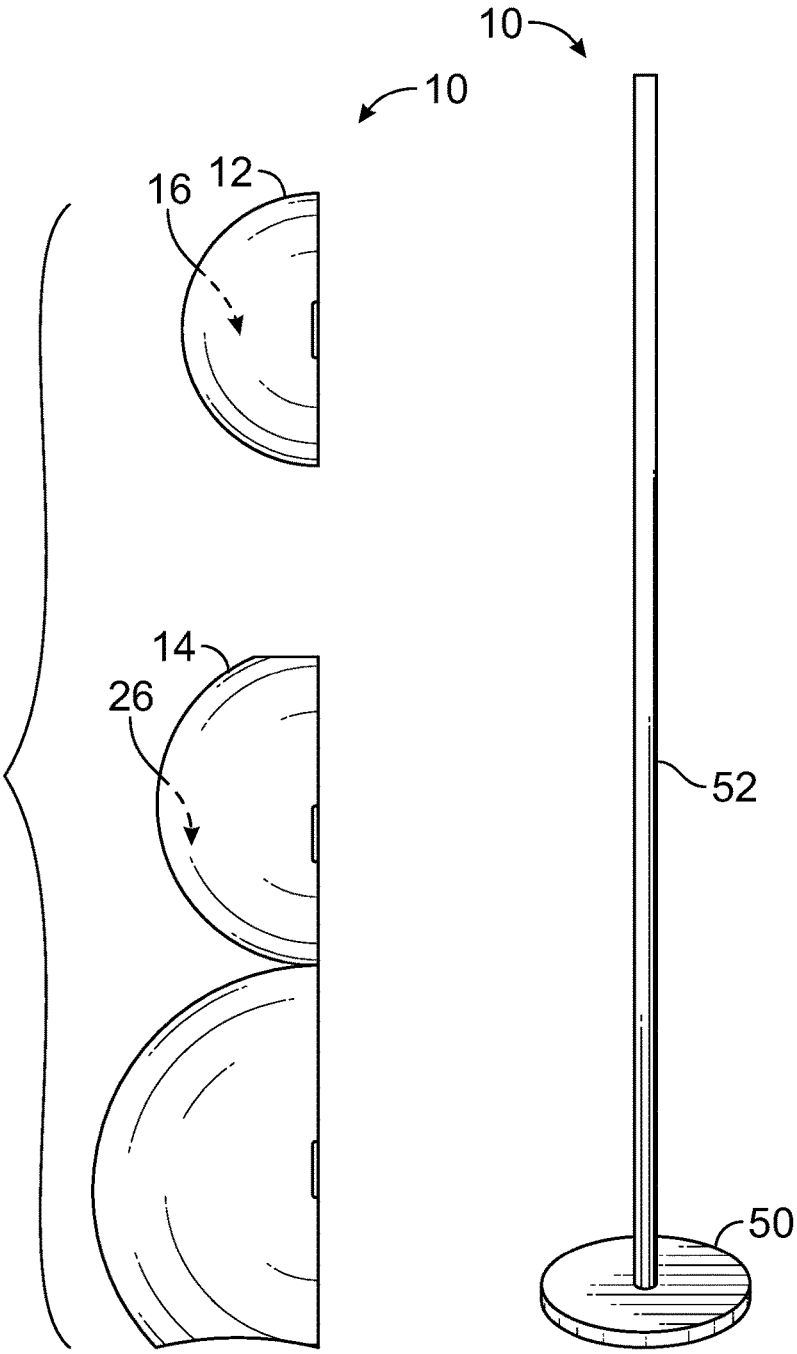
(Side View)
FIG. 3
(ISO Top View)
FIG. 4
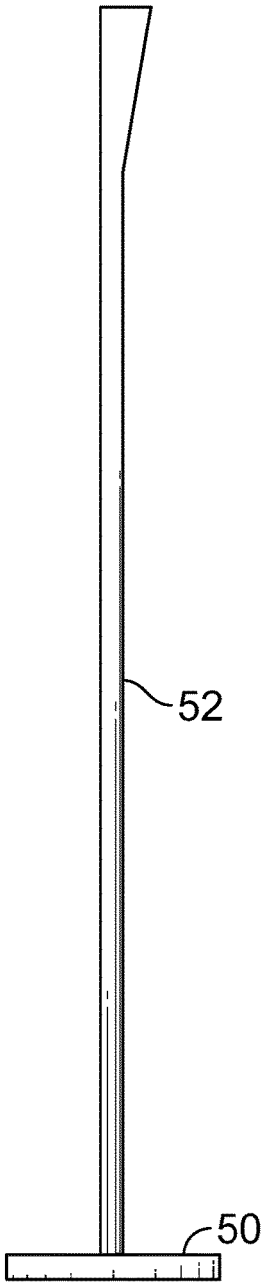
(Front View)
FIG. 5

(In-Use View)

(In-Use View)

(In-Use View)

(In-Use View)

SNOWMAN FORMING DEVICE AND METHOD OF USE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to forming devices and more particularly pertains to a new forming device for facile creation of a snowman. The present invention discloses forming device comprising a pair of molds for forming a snowman wherein each mold can be separated into two equal halves, fastened together around a mound of snow, then stacked atop of each other before finally being removed to expose a snowman.

(2) Description of Related Art Including Information Disclosed Under 37 CFR 1.97 and 1.98

The prior art relates to forming devices. Prior art forming devices for snowmen may comprise a single mold devices and three mold devices with and without connecting rings. What is lacking in the prior art is a forming device comprising a pair of molds for forming a snowman wherein each mold can be filled and packed with snow, stacked atop of each other, and then removed by separation into two equal halves to expose a snowman.

(h) BRIEF SUMMARY OF THE INVENTION

An embodiment of the disclosure meets the needs presented above by generally comprising a first mold and a second mold. The first mold defines an interior space, is substantially spherical, and comprises a pair of first shells, the first shells of which are hingedly engaged and selectively mutually engageable. The second mold defines an internal space and comprises an upper lobe and a lower lobe. The upper lobe is substantially spherical and is circumferentially larger than the first mold. The lower lobe is substantially spherical and is circumferentially larger than the upper lobe. The second mold comprises a pair of second shells, the second shells of which are selectively mutually engageable. A first cutout is positioned in an upper end of the second mold. A second cutout is positioned in a lower end of the second mold.

The first mold and the second mold are configured to be filled and packed with snow. A user is positioned to position the second cutout on a surface, and to position the first mold upon the first cutout to form a snowman within the first mold and the second mold. The user then is positioned to disengage the first shells and the second shells to reveal the snowman.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein:

FIG. 3 is a side view of an embodiment of the disclosure.

FIG. 4 is an isometric perspective view of an embodiment of the disclosure.

FIG. 5 is a front view of an embodiment of the disclosure.

(j) DETAILED DESCRIPTION OF THE INVENTION

Figure 1:
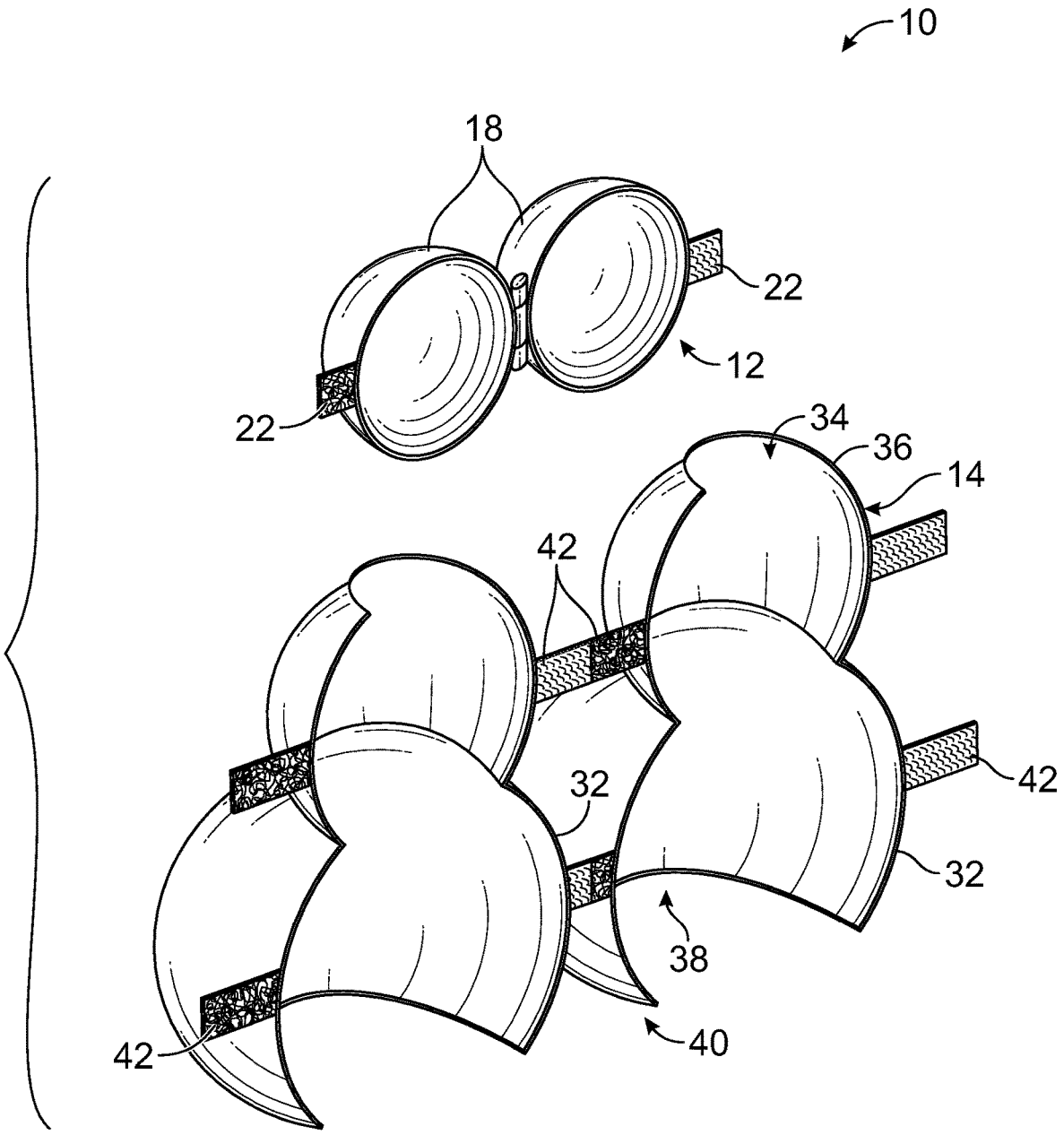
FIG. 1 is an isometric perspective view of a snowman forming device according to an embodiment of the disclosure.

With reference now to the drawings, and in particular to FIGS. 1 through 10 thereof, a new forming device embodying the principles and concepts of an embodiment of the disclosure and generally designated by the reference numeral 10 will be described.

Figure 2:
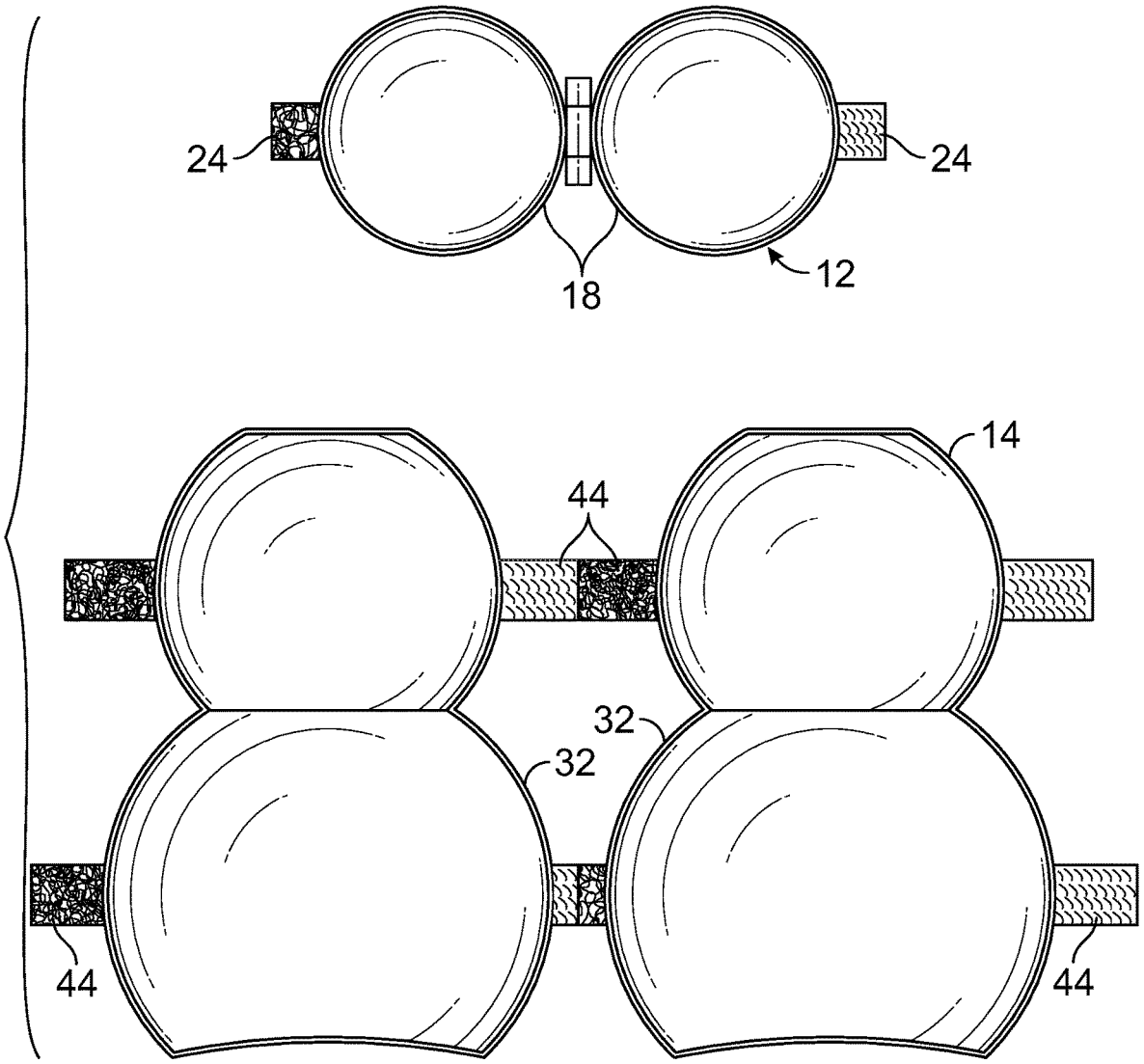
FIG. 2 is a front view of an embodiment of the disclosure.
Figure 6:
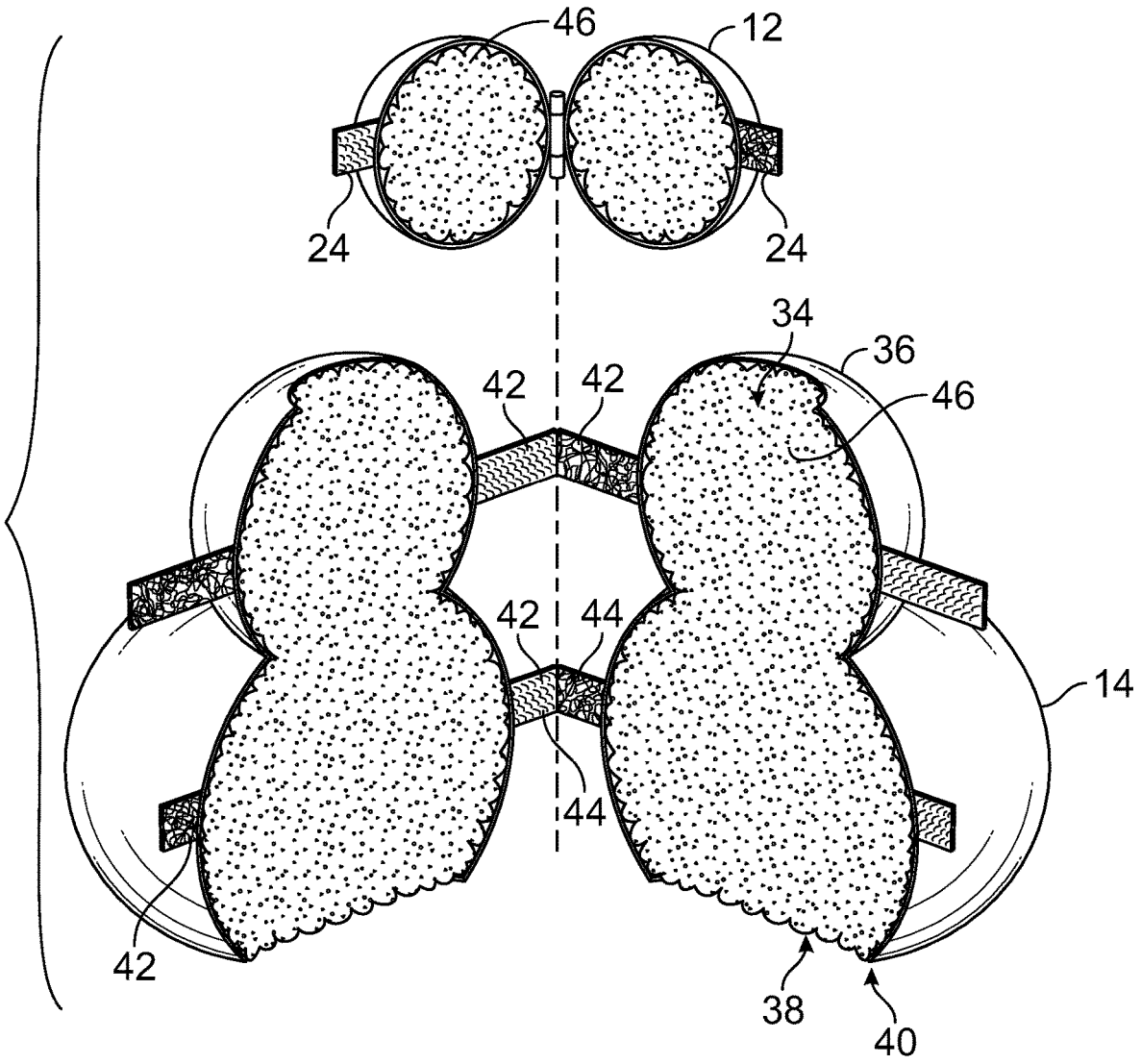
FIG. 6 is an in-use of an embodiment of the disclosure.
Figure 7:
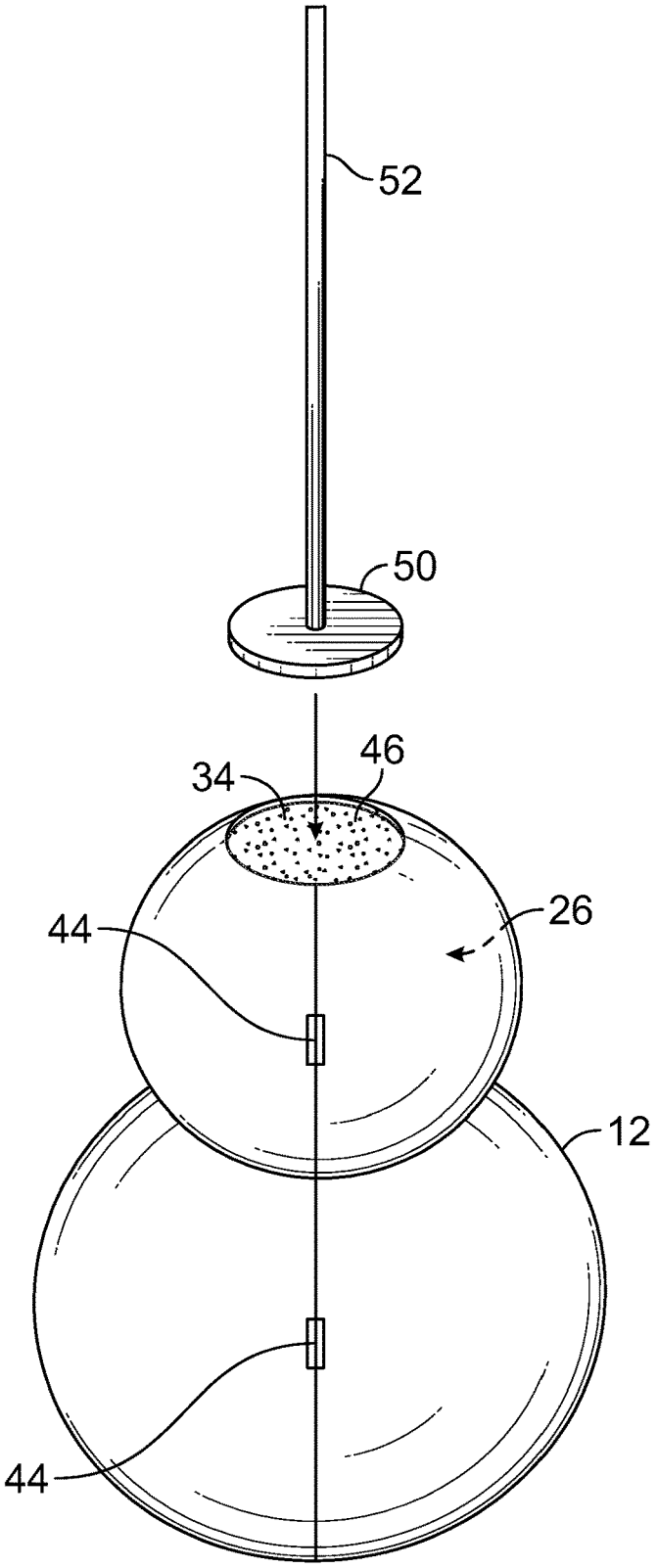
FIG. 7 is an in-use view of an embodiment of the disclosure.
Figure 8:
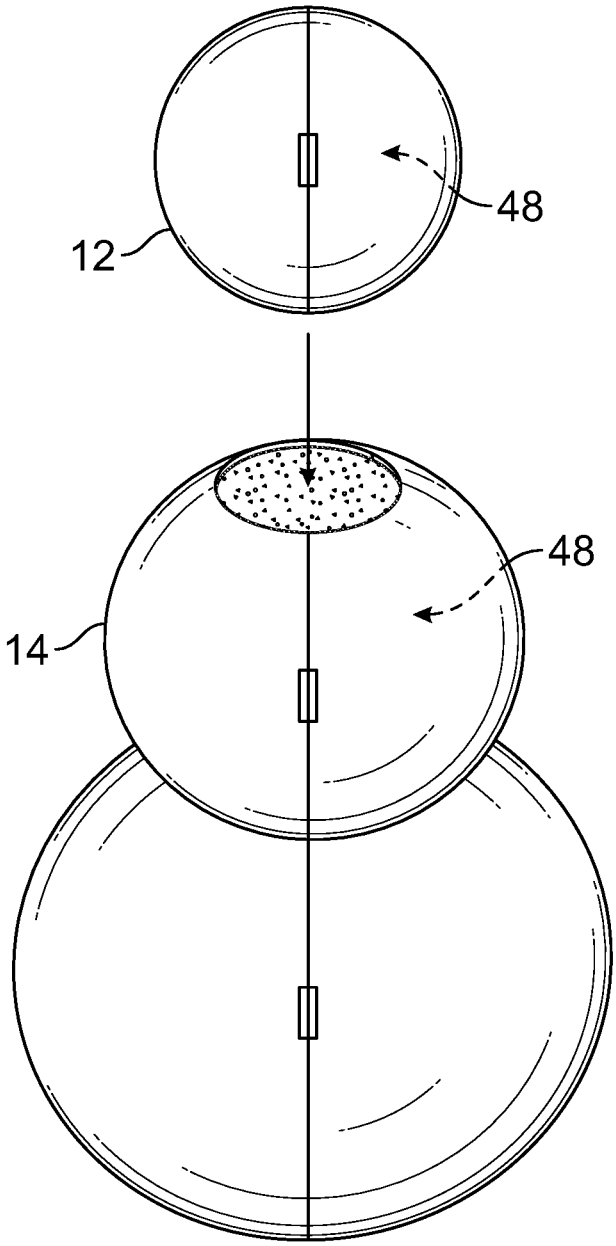
FIG. 8 is an in-use view of an embodiment of the disclosure.

As best illustrated in FIGS. 1 through 10, the snowman forming device 10 generally comprises a first mold 12 and a second mold 14, as shown in FIG. 8. The first mold 12 defines an interior space 16, is substantially spherical, and comprises a pair of first shells 18, the first shells 18 of which are hingedly engaged and selectively mutually engageable, as shown in FIG. 2. A pair of first fasteners 22 is engaged singly to the first shells 18. The first fasteners 22 are selectively mutually engageable to mutually engage the first shells 18. The pair of first fasteners 22 may comprise a first hook and loop fastener 24, or other fastening means, such as, but not limited to, clasps, clamps, and the like.

The second mold 14 defines an internal space 26 and comprises an upper lobe 28 and a lower lobe 30, as shown in FIG. 8. The upper lobe 28 is substantially spherical and is circumferentially larger than the first mold 12. The lower lobe 30 is substantially spherical and is circumferentially larger than the upper lobe 28. The second mold 14 comprises a pair of second shells 32, the second shells 32 of which are selectively mutually engageable, as shown in FIG. 2.

A first cutout 34 is positioned in an upper end 36 of the second mold 14. A second cutout 38 is positioned in a lower end 40 of the second mold 14. Each of a plurality of second fasteners 42 is engaged to a respective second shell 32. The second fasteners 42 are selectively mutually engageable so that each second fastener 42 is positioned to selectively engage an associated second fastener 42 to mutually engage the second shells 32. The second fastener 42 and the associated second fastener 42 may comprise a second hook and loop fastener 44, or other fastening means, such as, but not limited to, clasps, clamps, and the like.

Figure 9:
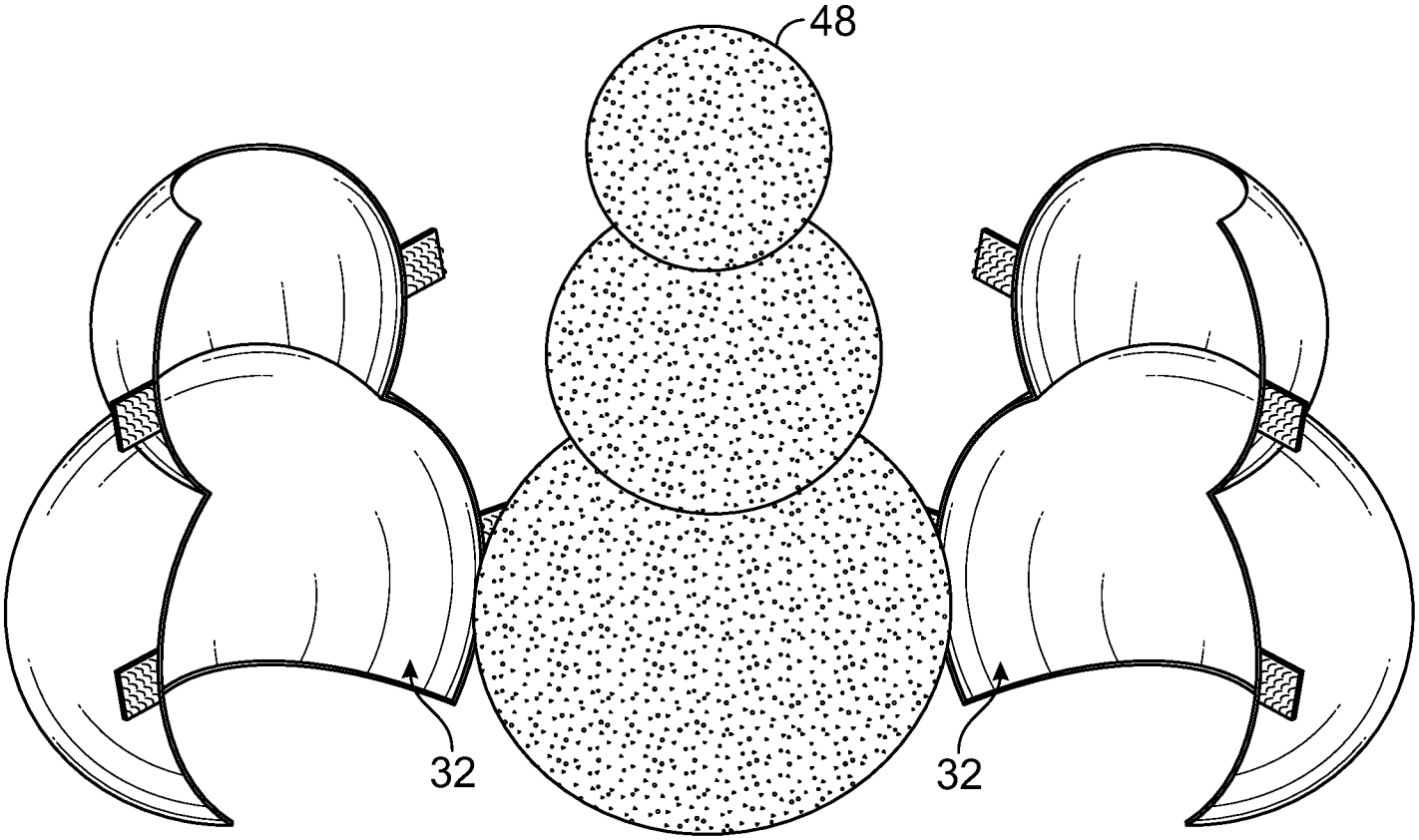
FIG. 9 is an in-use view of an embodiment of the disclosure.
Figure 10:
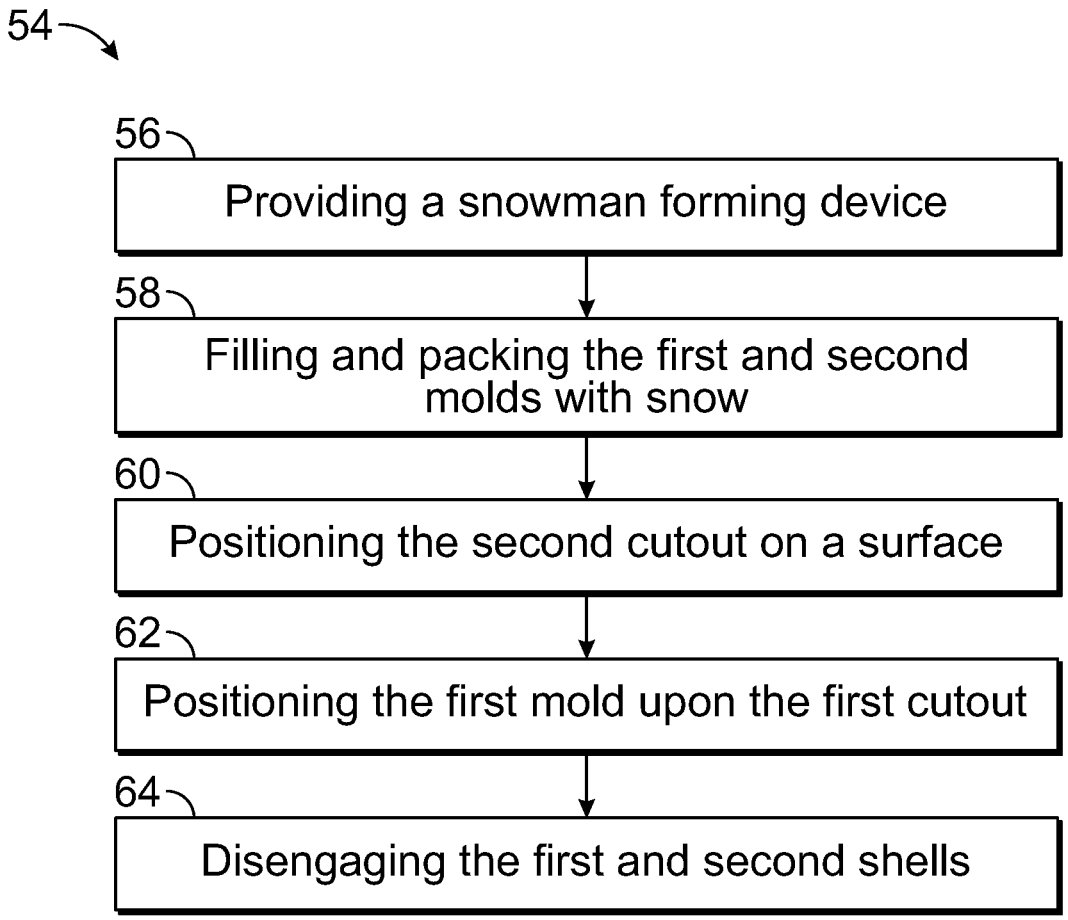
FIG. 10 is a flow diagram for a method utilizing an embodiment of the disclosure.

The first mold 12 and the second mold 14 are configured to be filled and packed with snow 46, as shown in FIG. 7. A user then can position the second cutout on a surface and the first mold 12 upon the first cutout 34, as shown in FIG. 8, to form a snowman 48 within the first mold 12 and the second mold 14. The user then is positioned to disengage the first shells 18 and the second shells 32 to reveal the snowman, as shown in FIG. 9.

The snowman forming device 10 also may comprise a plate 50 and a rod 52, as shown in FIGS. 4 and 5. The plate 50 may be substantially circular, although the present invention anticipates the plate 50 being alternatively shaped, such as, but not limited to, oval, square, and the like. The rod 52 is engaged to and extends axially from the plate 50. The rod 52 is configured to be grasped in a hand of the user, positioning the user to press the plate 50 onto snow 46 that is positioned in the first mold 12 and the second mold 14 to pack the snow 46.

In use, the snowman forming device 10 enables a method 54 of forming a snowman 48. The method 54 comprises a first step 56 of providing a snowman forming device 10 according to the specification above. A second step 58 of the method 54 is filling and packing the first mold 12 and the second mold 14 with snow 46. A third step of the method 54 is positioning the second cutout 38 on a surface. A fourth step 62 of the method 54 is positioning the first mold 12 upon the first cutout 34 to form a snowman 48 within the first mold 12 and the second mold 14. A fifth step 64 of the method 54 is disengaging the first shells 18 and the second shells 32 to reveal the snowman 48.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A snowman forming device comprising:

a first mold defining an interior space, the first mold being substantially spherical, the first mold comprising a pair of first shells, the first shells being hingedly engaged and selectively mutually engageable;

a second mold defining an internal space, the second mold comprising an upper lobe and a lower lobe, the upper lobe being substantially spherical and circumferentially larger than the first mold, the lower lobe being substantially spherical and circumferentially larger than the upper lobe, the second mold comprising a pair of second shells, the second shells being selectively mutually engageable;

a first cutout positioned in an upper end of the second mold; and a second cutout positioned in a lower end of the second mold, wherein the first mold and the second mold are configured for filling and packing with snow, the second cutout is configured to be positioned on a surface, the first mold is configured to be positioned upon the first cutout for forming a snowman within the first mold and the second mold, and the first shells and the second shells are configured to be disengaged for revealing the snowman;

a pair of first fasteners engaged singly to the first shells, the first fasteners being selectively mutually engageable for mutually engaging the first shells, the pair of first fasteners comprises a first hook and loop fastener, complementary faces of the pair of first fasteners facing each other and extending away radially from the first shells when mutually engaged; and a plurality of second fasteners, each second fastener being engaged to a respective second shell, the second fasteners being selectively mutually engageable, such that each second fastener is positioned for selectively engaging an associated second fastener for mutually engaging the second shells, the second fastener and the associated second fastener comprise a second hook and loop fastener, complementary faces of the plurality of second fasteners facing each other and extending away radially from the second shells when mutually engaged, the plurality of second fasteners including a pair of joining second fasteners integrally joined at distal edges of the joining second fasteners and extending between the second shells wherein the joining second fasteners couple the second shells together.

2. The snowman forming device of claim 1, further including:

a plate; and a rod engaged to and extending axially from the plate, wherein the rod is configured to be grasped and the plate is configured to be pressed onto snow for packing the snow.

3. The snowman forming device of claim 2, wherein the plate is substantially circular.

4. A method of creating a snowman using a snowman forming device, the method comprising the steps of:

providing a snowman forming device comprising:

a first mold defining an interior space, the first mold being substantially spherical, the first mold comprising a pair of first shells, the first shells being hingedly engaged and selectively mutually engageable, a second mold defining an internal space, the second mold comprising an upper lobe and a lower lobe, the upper lobe being substantially spherical and circumferentially larger than the first mold, the lower lobe being substantially spherical and circumferentially larger than the upper lobe, the second mold comprising a pair of second shells, the second shells being selectively mutually engageable, a first cutout positioned in an upper end of the second mold, a second cutout positioned in a lower end of the second mold, the second mold having diametrically opposed vertical edges extending fully between the first cutout and the second cutout wherein the second shells are disengageable from each other by lateral movement separating the second shells, a pair of first fasteners engaged singly to the first shells, the first fasteners being selectively mutually engageable for mutually engaging the first shells, complementary faces of the pair of first fasteners facing each other and extending away radially from the first shells when mutually engaged, and a plurality of second fasteners, each second fastener being engaged to a respective second shell, the second fasteners being selectively mutually engageable, such that each second fastener is positioned for selectively engaging an associated second fastener for mutually engaging the second shells, complementary faces of the plurality of second fasteners facing each other and extending away radially from the second shells when mutually engaged, the plurality of second fasteners including a pair of joining second fasteners integrally joined at distal edges of the joining second fasteners and extending between the second shells wherein the joining second fasteners couple the second shells together;

filling and packing the first mold and the second mold with snow;

positioning the second cutout on a surface;

positioning the first mold upon the first cutout for forming a snowman within the first mold and the second mold; and disengaging the first shells and the second shells for revealing the snowman.

5. The method of creating a snowman of claim 4, wherein:

the pair of first fasteners comprises a first hook and loop fastener; and the second fastener and the associated second fastener comprise a second hook and loop fastener.

6. The method of creating a snowman of claim 4, further including:

a plate;

a rod engaged to and extending axially from the plate, wherein the rod is configured for grasping in a hand of the user; and the method comprising an additional step of pressing the plate onto the snow positioned in the second mold for packing the snow.

7. The method of creating a snowman of claim 6, wherein the plate is substantially circular.

8. A snowman forming device comprising:

a first mold defining an interior space, the first mold being substantially spherical, the first mold comprising a pair of first shells, the first shells being hingedly engaged and selectively mutually engageable;

a second mold defining an internal space, the second mold comprising an upper lobe and a lower lobe, the upper lobe being substantially spherical and circumferentially larger than the first mold, the lower lobe being substantially spherical and circumferentially larger than the upper lobe, the second mold comprising a pair of second shells, the second shells being selectively mutually engageable;

a first cutout positioned in an upper end of the second mold;

a second cutout positioned in a lower end of the second mold, wherein the first mold and the second mold are configured for filling and packing with snow, the second cutout is configured to be positioned on a surface, the first mold is configured to be positioned upon the first cutout for forming a snowman within the first mold and the second mold, and the first shells and the second shells are configured to be disengaged for revealing the snowman;

a pair of first fasteners engaged singly to the first shells, the first fasteners being selectively mutually engageable for mutually engaging the first shells, the pair of first fasteners comprising a first hook and loop fastener, complementary faces of the pair of first fasteners facing each other and extending away radially from the first shells when mutually engaged;

a plurality of second fasteners, each second fastener being engaged to a respective second shell, the second fasteners being selectively mutually engageable, such that each second fastener is positioned for selectively engaging an associated second fastener for mutually engaging the second shells, the second fastener and the associated second fastener comprising a second hook and loop fastener, complementary faces of the plurality of second fasteners facing each other and extending away radially from the second shells when mutually engaged, the plurality of second fasteners including a pair of joining second fasteners integrally joined at distal edges of the joining second fasteners and extending between the second shells wherein the joining second fasteners couple the second shells together;

a plate, the plate being substantially circular; and a rod engaged to and extending axially from the plate, wherein the rod is configured to be grasped and the plate is configured to be pressed onto snow for packing the snow.

* * * * *